United States Patent [19]

Revillet et al.

[11] 4,010,892

[45] Mar. 8, 1977

[54] CENTRIFUGE EQUIPMENT AND ANALYTICAL SYSTEM USING IT

[75] Inventors: Georges Revillet, Onex; Manuel C. Sanz, Grand-Lancy, both of Switzerland

[73] Assignee: Micromedic Systems, Inc., Horsham, Pa.

[22] Filed: July 14, 1975

[21] Appl. No.: 595,954

[52] U.S. Cl. ..... 233/23 A; 233/26

[51] Int. Cl.[2] ..... B04B 9/14

[58] Field of Search ..... 233/23 A, 26, 1 C, 27

[56] References Cited

UNITED STATES PATENTS

| | | | |
|---|---|---|---|
| 2,202,157 | 5/1940 | Levy | 233/26 |
| 3,401,876 | 9/1968 | Lucas | 233/26 |
| 3,674,198 | 7/1972 | Eberle | 233/26 |
| 3,834,613 | 9/1974 | Hankey | 233/26 |
| 3,873,021 | 3/1975 | Paulsen | 233/26 |

*Primary Examiner*—George H. Krizmanich

[57] ABSTRACT

The present invention is concerned wit analytical equipment comprising a centrifuge and means for introducing and/or withdrawing from the centrifuge, a carrier for liquid materials to be centrifuged in preparation for testing. The centrifuge comprises a plurality of swing supports, such as buckets or baskets, for holders or carriers of the liquids to be centrifuged, and counterweight or balancing means for assuring balanced operation even though one or more of the swing supports is or are empty while others are loaded with carriers. Provision is also made to avoid the necessity to lower a carrier for the material to be centrifuged into the centrifuge and later lifting it out. Instead, the material is supplied and discharged in a horizontal path, avoiding the lowering and lifting. When a protective cover or casing is provided, "windows" may be made adjacent the swing supports therein to permit such transfer into and out of the centrifuge, and in a preferred embodiment, the swing supports carry curtains for closing the windows automatically during operation.

7 Claims, 6 Drawing Figures

FIG. 4
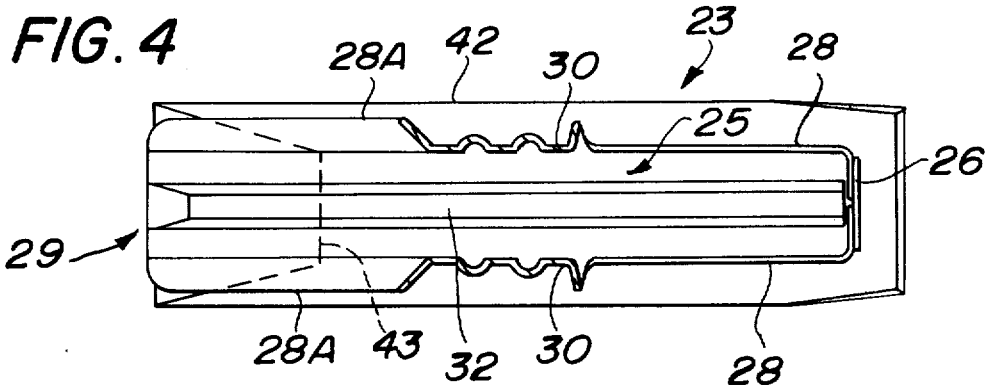
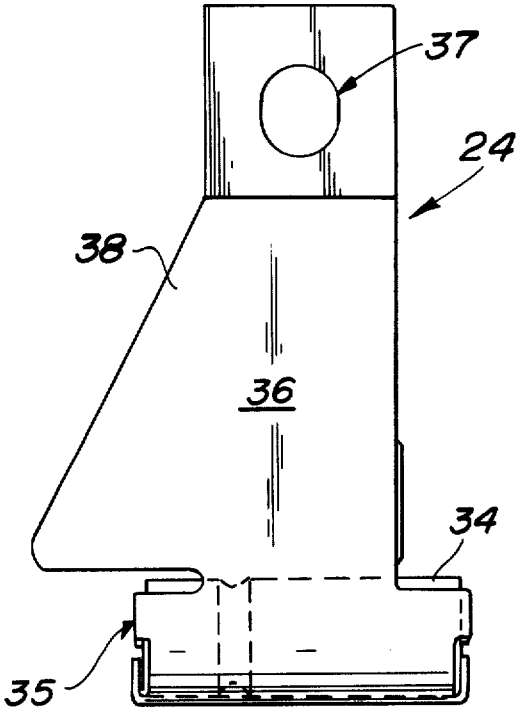
FIG. 5
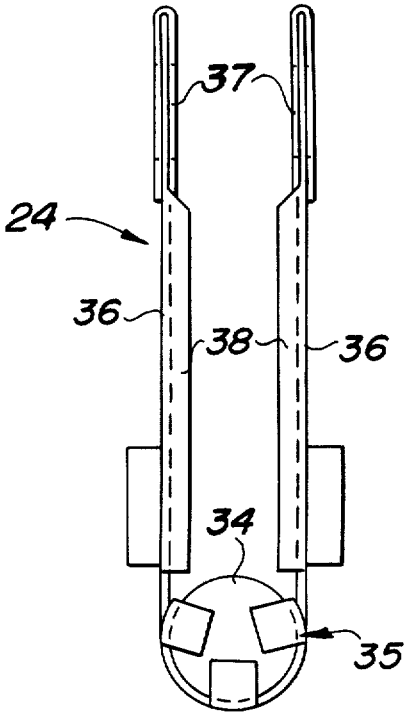
FIG. 6

CENTRIFUGE EQUIPMENT AND ANALYTICAL SYSTEM USING IT

DESCRIPTION OF THE INVENTION

The present invention is concerned with a device for centrifuging liquid samples, specimens, or mixtures comprising one or more of them mixed with diluent, solvent, reagent, or other test medium in analytical procedures particularly for analysis of body fluids, such as blood serum, blood plasma, lymph, or urine. The centrifugation, for example, may be employed to facilitate sedimentation of suspended matter present in the liquid to be analyzed either as it is initially obtained from the animal body or after being subjected to an additive material, such as a reagent, which may form products containing suspended matter in the liquid medium. In either case, the centrifugation is intended to facilitate sedimentation of suspended matter so that the resulting product would have a relatively clear supernatant above a portion constituting the sediment component.

The present invention is concerned with an improved centrifuge having a rotor on a vertical axis in which the rotor system comprises a plurality of radially outwardly swinging supports suspended pivotally on the rotor at equidistantly spaced points circumferentially of the centrifuge rotor. It is one of the objects of the invention to provide such a centrifuge which has means for automatically balancing the rotor during centrifugation even if a sample-holding unit has been omitted from one or more of the swing supports. The present invention also may comprise a cover, housing or shell for the rotor unit that provides protection against the possible escape of one of the swings or a sample holder therein during centrifugation.

It is another object of the present invention to provide for the insertion of a sample-holding unit into the swing support while the centrifuge is in an arrested position for loading. Another object is to provide the removal of the centrifuged sample holder from a peripheral zone of the centrifuge that is spaced from the loading zone and to enable the loading and unloading to occur from lateral positions of the centrifuge rather than from above it. In order to accomplish this purpose, the rotor cover, shell or casing is provided with windows equidistantly spaced about the shell in locations corresponding to the positions of the swing supports. It is also an object of the invention to provide "windows" or openings circumferentially of the centrifuge cover or casing that are normally open for access when the rotor is in arrested position and to provide means associated with each swing support for automatically closing the windows during centrifugation.

Another object of the invention is to provide a sample-holding unit having a plurality of receptacles arranged longitudinally of the holder so that the holder with its content of specimens or samples in the several receptacles, or in test tubes or vials disposed in the receptacles, can be inserted into the centrifuge while it is stopped with its windows open by pushing the sample holder longitudinally into the swing support at one position about the periphery of the arrested centrifuge and the holder can be removed at another position about the circumference of the centrifuge through the same opening, the insertion and removal being effected along substantially horizontal paths so that it is unnecessary to lift or lower the sample holders into the respective centrifuge swing supports.

These and other objects and advantages of the centrifuge and associated analytical system and apparatus will be apparent from the drawing and description thereof hereinafter.

In the drawing, which is illustrative of the invention,

FIG. 4 is a section of the support taken on line 4—4 in FIG. 3;

FIG. 5 is a side view of a counterweight means for the swingable support shown in FIGS. 3 and 4; and FIG. 6 is a view of the weight means taken in the direction from the left of FIG. 5.

The centrifuge equipment of the present invention is adapted for use in centrifuging small samples and particularly holders or carriers for a plurality of vials or test tubes containing the liquid specimens with or without a "reagent", wherein the latter may include a diluent, solvent, and/or a material reactive with the specimen or sample to be analyzed. It is particularly useful for acting upon carriers containing a plurality of individual containers such as test tubes for holding samples or associated control or standardizing solutions. For this purpose, the carrier or holder for the containers may have a plurality of recesses or sockets in each of which or in one or more of which a container for associated liquids to be tested may be supplied.

Figure 1:
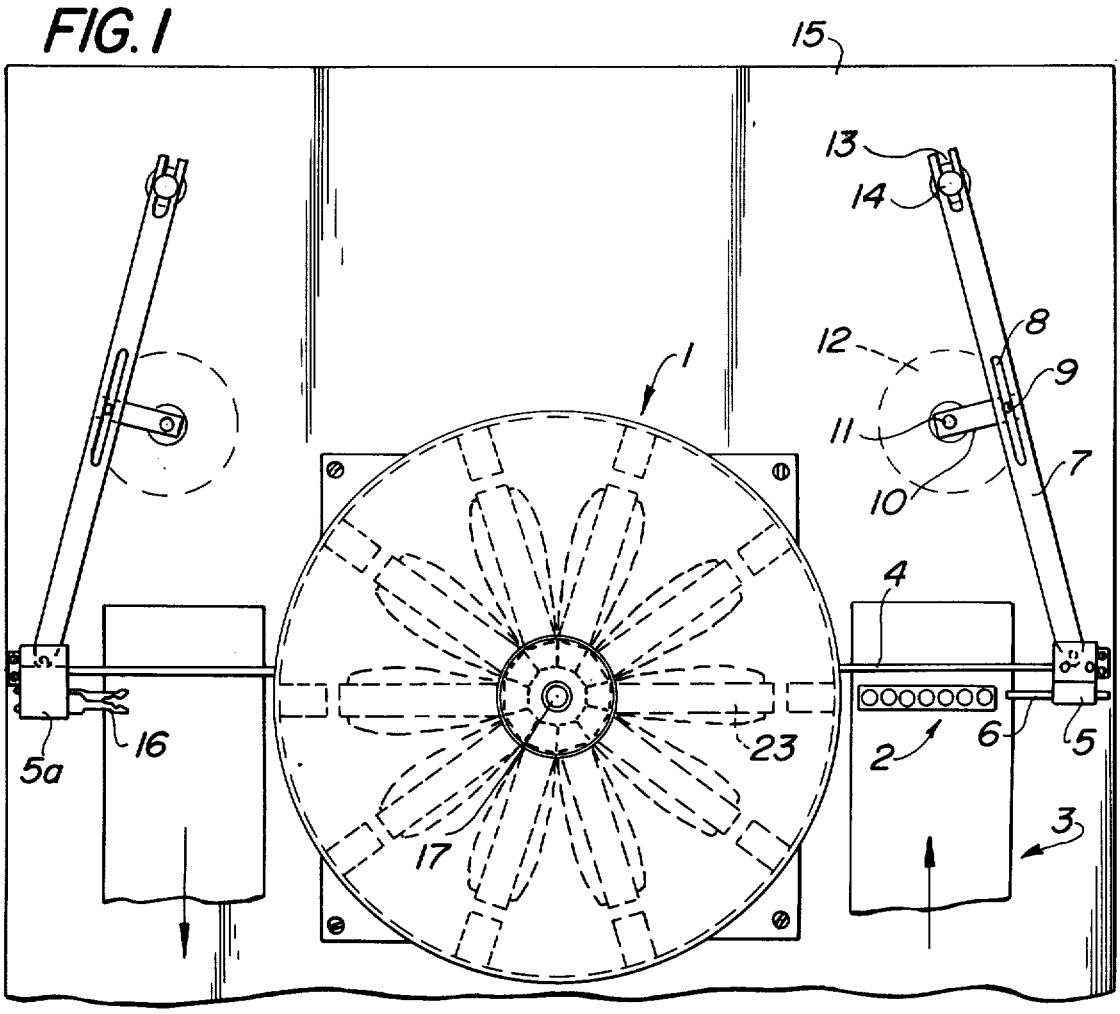
FIG. 1 is a plan view, somewhat diagrammatic in part, of the centrifuge of the present invention and associated loading and unloading means.

As shown in FIG. 1, which is a plan view of the centrifuge equipment, the centrifuge is indicated by reference character 1 and adjacent its periphery, there is shown in one position, means for pushing a carrier 2 from a zone just outside the periphery of the centrifuge into a swing support, basket or bucket within the centrifuge. A plurality of carriers 2 may be directed to the entry position shown in FIG. 1 by any suitable means, such as a belt 3 moving in the direction of the arrow. Just above the belt, a guide rod 4 is provided on which a slide member 5 having a push rod 6 is mounted. Pivotally connected to the slide member 5 is a lever 7 having an intermediate slot 8 receiving a pin 9 projecting up from the arm 10 secured to the drive shaft 11 of a motor shown in dotted outline at 12. The other end of the lever 7 is slotted at 13 to allow shifting of the lever 7 relative to the fixed pin 14 on the base 15 of the equipment. At the time of loading the centrifuge, the motor 12 is operated through a cycle causing the pushing of the carrier 2 into a basket or swing support of the centrifuge. Means is also provided along another zone of the centrifuge periphery, such as the zone 180° from that of the means for feeding the carriers into the centrifuge, for withdrawing the centrifuge carriers. Any suitable means may be employed and as shown, the driving means is essentially analogous to that for feeding the carriers into the centrifuge. However, instead of the push rod 6, grip means 16 are mounted on the corresponding slide 5*a*.

The centrifuge is provided with a plurality of buckets, baskets, or swing supports for receiving the carriers.

While as few as two to four may be provided, nevertheless, for the purposes of better balance and operation, it is preferable to have a greater number and as shown diagrammatically, twelve such swings are mounted within the centrifuge.

Figure 2:
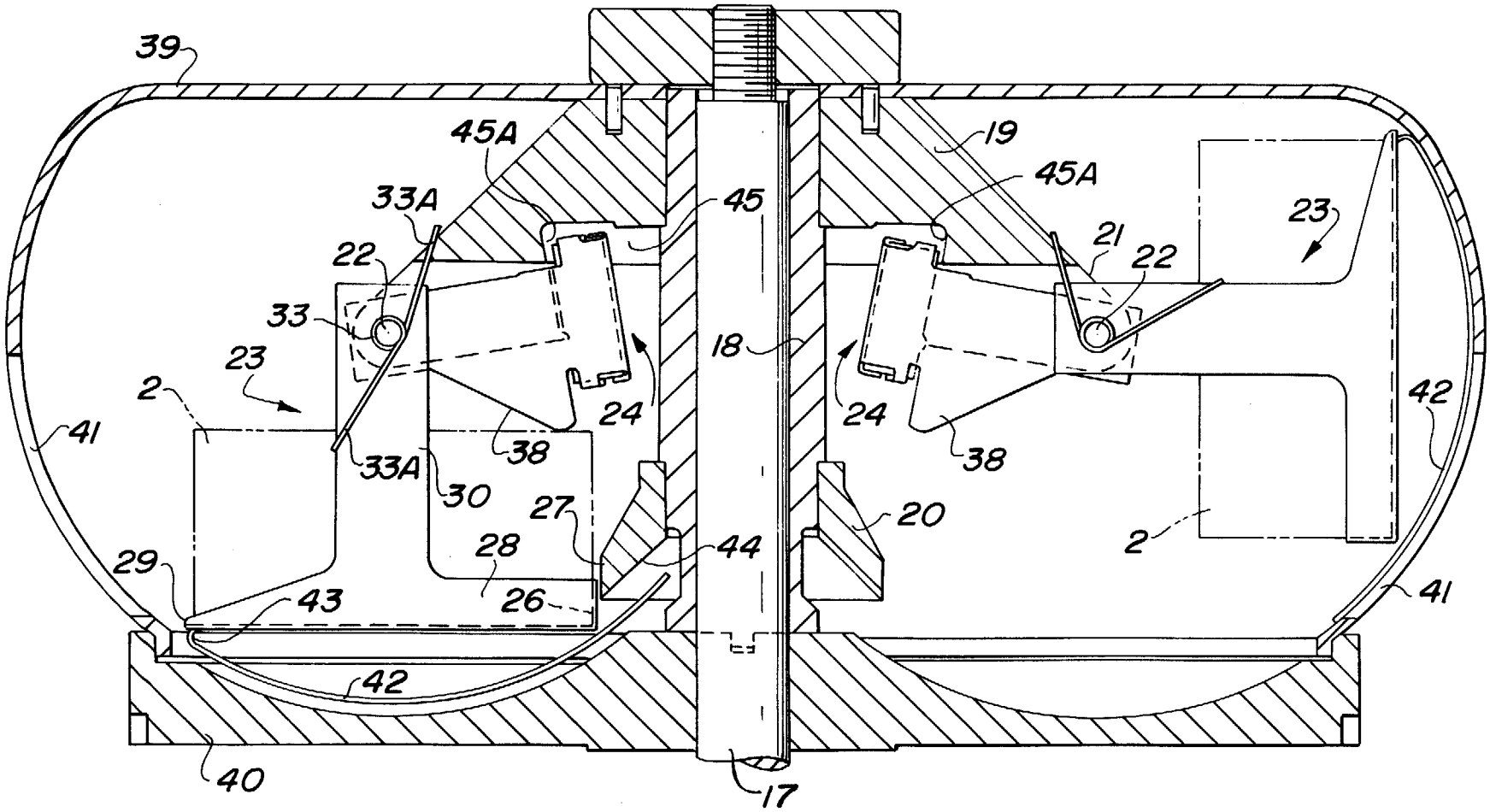
FIG. 2 is an axial section of the centrifuge showing one swingable support in position taken when the arrested centrifuge is being loaded or unloaded with a holder or carrier for article(s) to be or having been centrifuged and another charged support in its operating position.

FIG. 2 shows an axial section through the centrifuge and shows in greater detail the preferred construction thereof. It comprises rotor means including the shaft 17, the sleeve 18, an annular member 19 concentric with the axis of the shaft 17 and secured to the rotor 17 for rotation therewith. Part of the rotor means includes an annular skirt 20 which, as explained hereinafter, may serve as a positioning means for limiting the position taken by the swing supports when the centrifuge is at rest and when it is being loaded or carriers are being withdrawn therefrom.

The centrifuge, of course, normally is positioned with the axis of its rotor means vertically directed and the various elements of the centrifuge are described in terms of the centrifuge in a vertical position as shown in FIG. 2. The annular member 19 has a plurality of pairs of spaced lugs or ears 21 formed integrally therewith and projecting downwardly from the outer periphery of the main body of the member 19. Each pair of lugs is provided with a bore adapted to receive a pin 22 which serves to provide a pivotal axis (at right angles to a plane through the rotor axis) on which the swing support 23, such as a basket or bucket, may be pivotally mounted. These pins are equidistantly spaced from the rotor axis and their centers lie in a circle that is concentric with the rotor axis. The plurality of pins 22 are spaced equidistantly about the periphery of the annular member 19. These pins also support pivotally the balancing means 24 described shortly.

Figure 3:
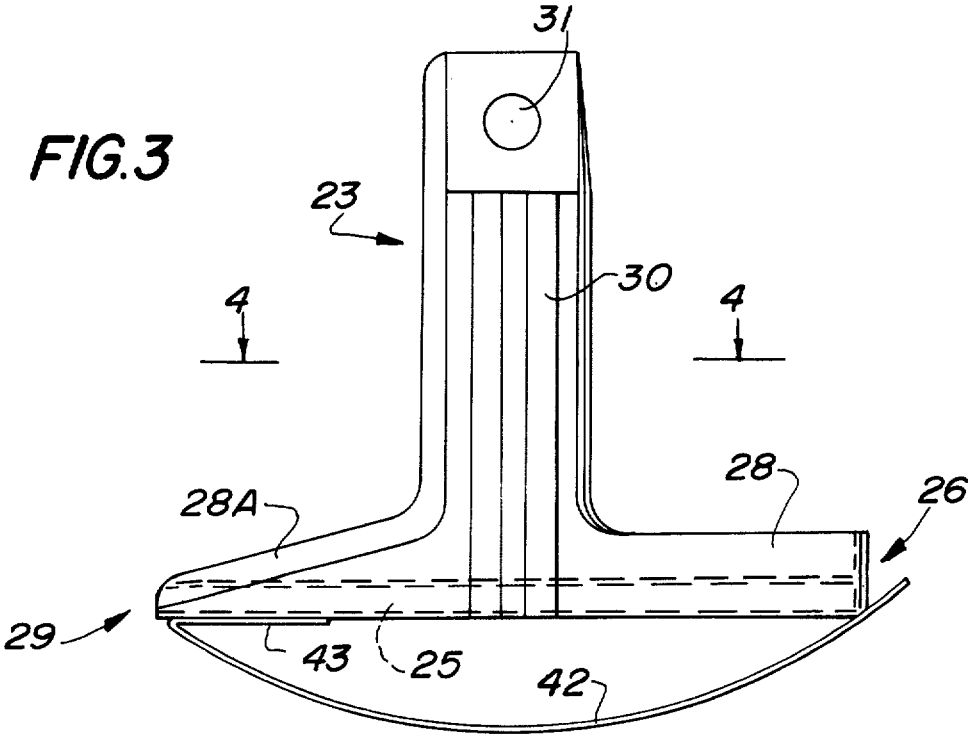
FIG. 3 is a side view of a swingable support.

FIGS. 3 and 4 show in more detail a preferred embodiment of the swing support, basket, or bucket which may be formed by cutting, punching and bending a piece of sheet metal. FIG. 4 is a plan view with parts in cross-section as taken on line 4—4 of FIG. 3. As shown in those figures, the swing support has a bottom portion in the form of a tray 25. This tray is closed at the end 26 which, in the arrested or still position of the centrifuge, is the end nearest to the rotor axis and would be limited in position by the outer periphery 27 of the skirt 20 (FIG. 2). Thus, the tray has two side walls 28, a closed end 26, and is open at the other end 29. The side walls 28, shown toward the open end of the tray, may be provided with laterally outwardly extending flared portions 28A which slope downwardly to the open end 29. Two lateral extensions 30 extend upwardly from the side walls 28 and at their upper ends are provided with bores 31 by which they may be pivotally mounted on one of the pins 22 (FIG. 2). The side walls or arms 30 may be corrugated to impart rigidity. Similarly, the bottom of the tray may be formed with a groove at 32 that extends longitudinally of the tray and increases its rigidity.

As shown in FIG. 2, a spring 33 may be coiled helically about the pin 22 and has one end 33A extending around the arm 30 and the other end 33A engaged with the annular member 19 so that the spring normally urges the swing toward the position shown at the left of FIG. 2 where the end 26 abuts the periphery 27 of the skirt 20. During centrifuging, this spring biassing is overcome by centrifugal force.

A preferred form of counterweight means 24 is shown in FIGS. 5 and 6. The means there shown comprises a weight element 34 embraced within a cage 35. The framework of the counterweight means may be formed from a single piece of sheet metal stamped out, punched and bent to the desired shape shown. Thus, the cage 35 may be formed by suitably bending such a piece of sheet metal, having a shape required to provide the structure shown in FIGS. 5 and 6, about the weight 34. Legs 36 extend from both sides of the weight to their ends which are perforated at 37. The openings 37 provided therein embrace the pin 22 about which the counterweight means is to be supported for functioning. The side legs 36 are formed with a sloped edge at 38 which preferably is bent over as shown in FIG. 6. As shown in FIG. 2, these sloped edges 38 are adapted to ride on the top surface of a carrier 2 when such carrier is inserted into the given swing. Normally, the counterweight means merely hangs, and is freely pivotal on, the pin 22.

The diameter of the perforations 37 is slightly larger than the pin 22 on which it pivots to provide free pivotal motion thereabout. However, for purposes hereinafter described, the diameter is somewhat enlarged in the direction of the length of the counterweight assembly.

The centrifuge may be provided with a casing or cover means 39. In the preferred form of the centrifuge, this cover is secured to a base plate 40 and to the annular member 19 for rotation with the rotor means. In a preferred embodiment also, this cover means is provided with window openings 41 of sufficient height and width to allow passage therethrough of the carrier or test tube holder intended to be introduced for centrifuging. This cover is concentric with the rotor means and at least the portion of the outer wall in which the windows are located is toroidal in form, having a geometrical shape in the surface of that portion that would be generated by rotation about the rotor axis of a circular arc having a center in the path taken by the centers of the pivotal axes during rotation of the centrifuge. By so forming the wall of the centrifuge cover in which the openings or windows are provided, such openings can be closed upon the swinging of the basket or bucket. For this purpose, there may be attached to the bottom of the tray of a respective bucket or swing holder an arcuate resilient closing element or curtain 42. As shown in FIGS. 3 and 4, this resilient member is turned back to form a segment 43 by which this element may be attached to the bottom of the swinging bucket tray near the open end 29. The length and width of this element is such as to assure that the entire opening is closed when the swing support is swung into the centrifuging position as illustrated at the right of FIG. 2. To accommodate this length in the position of rest shown at the left of FIG. 2, the skirt 20 is undercut at 44.

The annular member 19 is recessed at 45 and the outer wall 45A of this recess slopes downwardly and inwardly toward the rotor axis as shown in FIG. 2. This annular concentric surface 45A serves as a locking means for the counterweight when the counterweight means has been lifted into the position shown in both right and left sides of FIG. 2. The insertion of the carrier 2 causes swinging of the counterweight means (by engagement of the top surface of the carrier 2 against the sloped edges 38) into the position shown at the left of FIG. 2 wherein the center of gravity of the counterweight means is above a horizontal plane through the pivotal axes 22. At the same time, the upper end of the counterweight means projects into the recess 45. On operation of the centrifuge and because of the fact that the bores 37 of the counterweight means are somewhat elongated in the direction of the length of the counterweight means framework, centrifugal force causes the weight to engage the locking ring 45a as shown at the right in FIG. 2. Since the center of gravity of the counterweight means is above the horizontal plane containing pivots 22, the counterweight means remains locked at its internal position until centrifuging stops. It should be noted that the arms 36 of the counterweight means are spaced apart a lesser distance than the spacing apart of the upstanding arms 30 of the swing supports so that the spring 33 does not affect or interfere with the free swinging pendulous support of the counterweight means. The design of the counterweight means is so related to the mass of the loaded carrier that is normally introduced into a swing support that the distribution of the masses involved with an empty swing support and the outwardly swung counterweight means associated with the empty support on centrifuging develop essentially the same moment of inertia as a swing support loaded with a carrier with the counterweight means locked in the position shown in FIG. 2. Thus, even with a non-uniform distribution of loaded and unloaded swing supports, the entire centrifuge is in essentially dynamic balance. The design of the counterweight means is calculated so that for any empty support the sum of its own moment of inertia and the moment of inertia of the corresponding balancing mass outwardly swivelled or swung is equal to the sum of the moment of inertia of a loaded support and that of the corresponding balancing mass swivelled or swung inwardly; consequently, the rotor remains essentially balanced independently of the number and distribution of the loaded supports.

While the description herein has referred to a preferred embodiment, nevertheless it is to be understood that changes and variations may be made without departing from the spirit and scope of the claims hereinafter presented.

What is claimed is:

1. In equipment comprising a centrifuge for handling and centrifuging liquid material, especially in a carrier or holder for such material, wherein the centrifuge comprises rotor means having an annular axis, a plurality of swing supports on pivotal axes provided in, and spaced equidistantly about, the outer peripheral portion of the annular member, said pivotal axes lying in a common plane each extending at right angles to a radial line from the rotor axis, the improvement wherein the swing has an open-ended tray adapted to receive a carrier for the liquid material to be centrifuged, the open end of the tray being at the outer end of the tray in respect to the rotor axis when the centrifuge is arrested and the swing is in its position of rest, and where the rotor means and swing supports are enclosed by a concentric cover, said cover being secured to the rotor means for rotation therewith and having openings in alignment with the swing supports through which a carrier may be loaded into or withdrawn from each swing support when the centrifuge is stopped.

2. Equipment according to claim 1 in which counterweight means is pivotally suspended on the pivotal axis of each swing support, said counterweight means being constructed and arranged to (1) compensate for the lesser weight of the swing by being swung outwardly when a carrier is omitted from the swing support and (2) to be swung radially inwardly by the insertion of a carrier into the swing support so that the center of gravity of the counterweight means is above its pivotal axis.

3. Equipment according to claim 2 comprising means on the annular member engaged by the counterweight means when swung inwardly by a carrier for locking the counterweight means in position during centrifugation.

4. Equipment according to claim 3 in which the locking means comprises a concentric recess in the annular member having a downwardly and inwardly sloped outer periphery against which the counterweight means is engaged during centrifugation.

5. Equipment in accordance with claim 1 comprising means adjacent a peripheral zone of the centrifuge for pushing a carrier longitudinally through an opening of said cover into the tray of the swing support in alignment with the opening, and means adjacent another peripheral zone for withdrawing a carrier through the opening in the cover from the tray of the swing support in alignment with the opening.

6. Equipment in accordance with claim 5 in which at least the portion of the wall of the cover that is provided with the openings has a toroidal form generated by rotation about the rotor axis of a circular arc having a center in the path taken by the centers of the pivotal axes during rotation of the centrifuge, and each swing support has an arcuate resilient closing element attached to its bottom whereby on centrifuging, the swing supports put the elements in position to close the openings.

7. A centrifuge comprising rotor means having an annular member for supporting, equidistantly from the rotor axis, a plurality of swing supports on pivotal axes provided in, and spaced equidistantly about, the outer peripheral portion of the annular member, said pivotal axes lying in a common plane, each extending at right angles to a respective radial plane that extends through the rotor axis, each swing comprising an open-ended tray, the sides of which extend to its respective pivot, spring means for urging each swing toward its rest position upon stopping of the centrifuge rotation, counterweight means suspended on each of the pivotal axes for free swinging about its respective axis, a cover concentrically mounted on the rotor means for rotation therewith, openings in the wall of the cover adjacent the swing supports to facilitate entry and withdrawal of test tube carriers into and out of the swing supports when the centrifuge is still, and means on each swing support to close the adjacent openings upon rotation of the centrifuge.

* * * * *